US005945890A

United States Patent [19]

McCorkle

[11] Patent Number: 5,945,890

[45] Date of Patent: Aug. 31, 1999

[54] ULTRA-WIDE BANDWIDTH FIELD STACKING BALUN

[75] Inventor: John W. McCorkle, Laurel, Md.

[73] Assignee: The United States of America as represented by the Secretary of the Army, Washington, D.C.

[21] Appl. No.: 08/876,666

[22] Filed: Jun. 16, 1997

[51] Int. Cl.[6] ..... H01P 5/10

[52] U.S. Cl. ..... 333/26; 333/128

[58] Field of Search ..... 333/127, 128, 333/26, 33, 25

[56] References Cited

U.S. PATENT DOCUMENTS

| | | | |
|---|---|---|---|
| 2,877,427 | 3/1959 | Butler | 333/128 |
| 4,725,792 | 2/1988 | Lampe, Jr. | 333/26 |
| 5,172,082 | 12/1992 | Livingston et al. | 333/26 |
| 5,379,006 | 1/1995 | McCorkle | 333/26 |
| 5,523,728 | 6/1996 | McCorkle | 333/26 X |

*Primary Examiner*—Seungsook Ham

*Attorney, Agent, or Firm*—Paul S. Clohan, Jr.; Mark D. Kelly

[57] ABSTRACT

A balun structure is formed by stripline or square coaxial transmission lines and stacked dielectric substrates. The invention provides a technique for building a balun that maintaines low insertion loss and good balance for DC-to-GHz applications. The impedance ratio of the balanced transmission line to the unbalanced transmission line is $N^2$:1, where N is the number of microstrip transmission lines in the balun. This will prevent the signal loss that occurs when ferrite cores are placed around the transmission lines.

19 Claims, 6 Drawing Sheets

ULTRA-WIDE BANDWIDTH FIELD STACKING BALUN

RIGHTS OF THE GOVERNMENT

The invention described herein may be manufactured, used, and licensed by or for the United States Government for Governmental purposes without payment to us of any royalty thereon.

BACKGROUND OF THE INVENTION

1. Field of the Invention

The present invention relates to a wideband (DC to GHz) printed circuit board balun. This wideband balun is suitable for use in communication systems, radars, radio frequency transmitters, receivers, signal processors, and more specifically to ultra wide band (UWB) applications such as impulse radar. The word "balun" was derived by joining the words "balanced" and "unbalanced" together, since it is the function of a balun to connect a balanced electrical network to an unbalanced electrical network. A balanced network is one where no ground currents flow and instead, there is a "plus" wire and a "minus" wire that counteract or balance each other.

2. Description of the Prior Art

A great variety of baluns are available commercially that cover a broad spectrum in terms of size, bandwidth, center frequency, and insertion loss. However, these commercial baluns do not have the wide bandwidth, balance, insertion loss, or power handling capability required for ultra wide bandwidth applications such as impulse radar. Impulse radar is presently being used in a variety of radar systems to detect aircraft, ground vehicles, people, mines, buried pipes, roadway faults, buried homicide victims, tunnels, leaking buried pipes, and similar items. Consequently, it is desirable to have a balun that maintains low insertion loss and good balance for UWB applications. Accordingly, it is an object of this invention to provide a balun that maintains low insertion loss and good balance for UWB applications.

A recent example of a wide bandwidth balun is shown in U.S. Pat. No. 5,523,728 by the same inventor, filed on Aug. 17, 1994. U.S. Pat. No. 5,523,728 uses transmission lines formed by microstrip conductors on a printed circuit board to achieve a wide bandwidth. The balanced transmission lines formed by the balun are stacked about a ground plane which causes the fields of the signals to be aligned. In addition, the balun can divide the signal into more than two microstrip transmission lines, combine them, and stack balanced signal line outputs in order to increase the impedance ratio of the balun. Ferrite cores placed about the transmission lines and resistor-capacitor circuits improve the low frequency performance of the balun. When ferrite cores are placed about the transmission lines, however, there is a large depreciation in signal strength at high frequencies, limiting the frequency range of the balun.

SUMMARY OF THE INVENTION

Briefly, it is the object of this invention to provide a technique for building a balun that maintains low insertion loss and good balance for UWB (DC-to-GHz) applications. The impedance ratio of the balanced transmission line to the unbalanced transmission line is $N^2$:1, where N is the number of microstrip transmission lines comprising the balun. It is a further objective of this design to prevent the signal loss that occurs when ferrite cores are placed around the transmission lines.

The foregoing is achieved using a balun structure formed by stripline or square coaxial transmission lines, and stacked dielectric substrates. The balun also may include an input network which may be a series short-circuit or a capacitor for coupling an unbalanced input signal. An input transmission line with a characteristic impedance of Z ohms may also be connected to the input network. The input transmission line may be formed of stripline comprised of a first dielectric substrate having a first ground on top and a second dielectric substrate having a second ground on the bottom and a signal trace on the top wherein said second ground is connected to said first ground, and wherein the signal trace has a width to form a transmission line of characteristic impedance Z ohms. The unbalanced input signal is divided into N transmission lines by a splitter/combiner, where N is greater than or equal to two. The stripline or square coaxial transmission lines are comprised of at least one inverting and one non-inverting transmission line. The inverting and non-inverting transmission lines are connected in a manner to form a balanced signal line with a ground plane in between the balanced signals. This individual balun output can then be combined with other balanced signals, or with a single transmission line if N is odd, in order to form balanced signals with higher impedance ratios.

The inverting transmission line inverts the phase of the signal by converting the stripline to microstrip and then tapering the conductors that make up the microstrip. The signal line is tapered outward to form a ground plane, while the ground plane is simultaneously tapered in to form a signal line. The tapering is done such that the transmission line maintains nearly constant characteristic impedance, while the position of the ground plane is inverted with regard to the field in the transmission line. The inverted microstrip line can then be converted back into stripline if needed. All of the transmission lines, whether inverting or non-inverting must have substantially the same characteristic impedance and length in order to maintain equal signal time delays across the balun's entire frequency range. The balun also includes a series combining means receiving the inverting and non-inverting transmission lines and connecting them in series to produce a single output transmission line of impedance N×N×Z ohms. The series combining means is comprised of a first stripline-to-microstrip transition connected to said non-inverting transmission line wherein the first substrate of said non-inverting transmission line stops and the signal trace on the top of the second substrate tapers outwardly to maintain a characteristic impedance of N×Z ohms; a second stripline-to-microstrip transition connected to said second stripline section of said inverting transmission line wherein the third substrate of said non-inverting transmission line stops and the signal trace on the bottom of the second substrate tapers out to maintain a characteristic impedance of N×Z ohms; a microstrip field stacking section comprised of two substrates, a top substrate comprised of the second substrate of said first stripline-to-microstrip transition with a ground plane on the bottom and a first signal trace on the top, and a bottom substrate comprised of the second substrate of said second stripline-to-microstrip transition with a ground plane on the top and a signal trace on the bottom, wherein the ground planes are pressed together and electrically connected, and wherein the signal traces curve inward and then outward in an "S" shape so that they are positioned on top of one another. The series combining means may also be comprised of a plurality of N stripline to microstrip transitions each followed by a microstrip to balanced transition except for the two in the center of the said field stacking section, with the field stacking section comprised of a plurality of N substrates.

At the balanced signal end of the balun, there are N vertically stacked parallel dielectric substrates. The non-inverted side of the balanced signal output is on the top of the top substrate, while the inverted side of the balanced signal output is on the bottom of the bottom substrate. The ground planes formed by the combination of each pair of signals causes the balanced signals to have their fields aligned and they can be end launched directly into a load such as a horn antenna or a twin lead transmission line.

N−1 resistor-capacitor (RC) circuits placed throughout the balun prevent short circuits at DC such that the balun maintains low VSWR to DC and maintains power transfer to the load at frequencies down to and including DC. The RC circuits can be placed at several locations throughout the circuit to perform this function. These gap networks may comprise a resistor and capacitor in parallel, the resistor in such case having a value of (N*N*Z)/(N*N−1).

Ferrite cores can be placed around the transmission lines in order to improve low frequency performance. Shielding the transmission lines by using stripline or square coaxial line to form the transmission lines reduces this signal loss that occurs when cores are placed about microstrip and improves the high frequency performance of the balun.

BRIEF DESCRIPTION OF THE DRAWINGS

A better understanding of the invention will be obtained when the following detailed description of the invention is considered in connection with the accompanying drawings in which.

DETAILED DESCRIPTION OF SPECIFIC EMBODIMENTS

The following detailed description of the Shielded Stripline Ultra Wide Band Balun is of one specific embodiment of the balun, along with several variations of the balun. The description of the balun described in U.S. Pat. No. 5,523,728 by this same inventor is divided into three sections: the input and splitter/combiner section, the transmission line section, and the field stacking and balanced output section. This invention is primarily related to the transmission line section. U.S. Pat. No. 5,523,728 can be referenced for a more detailed description of the input and splitter/combiner section and the field stacking and balanced output section of the balun.

Figure 5:
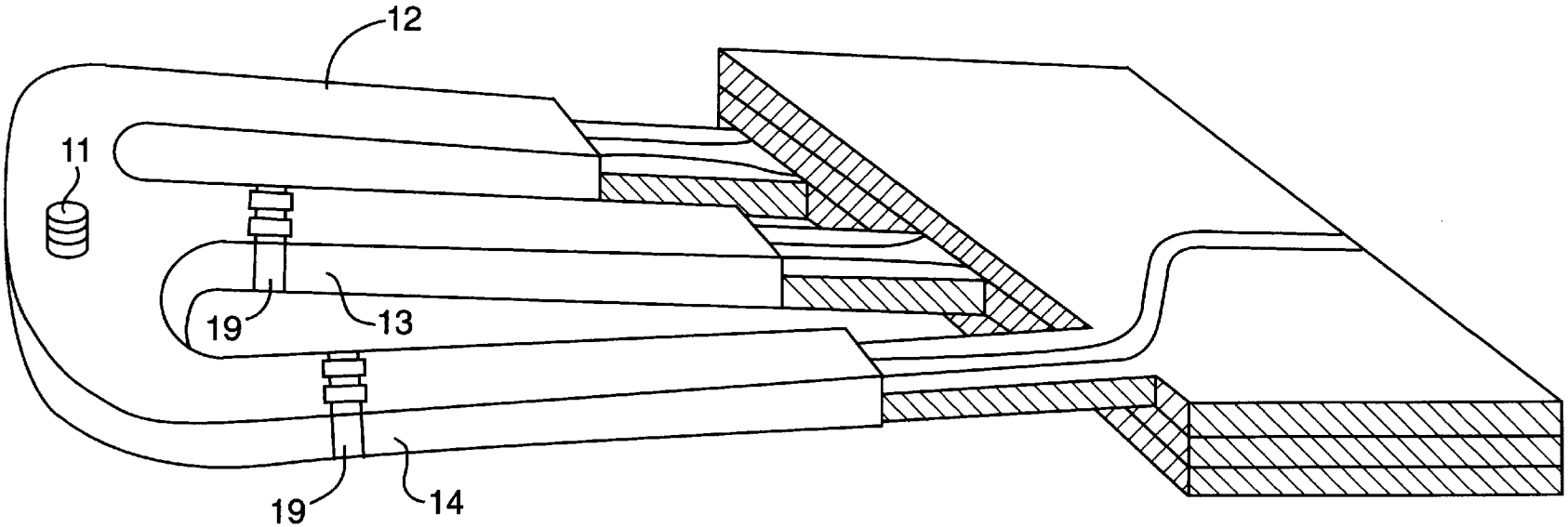
FIG. 5 depicts an elevated side angle view of a 9:1 impedance ratio balun comprising three square shield coaxial transmission lines.
Figure 6:
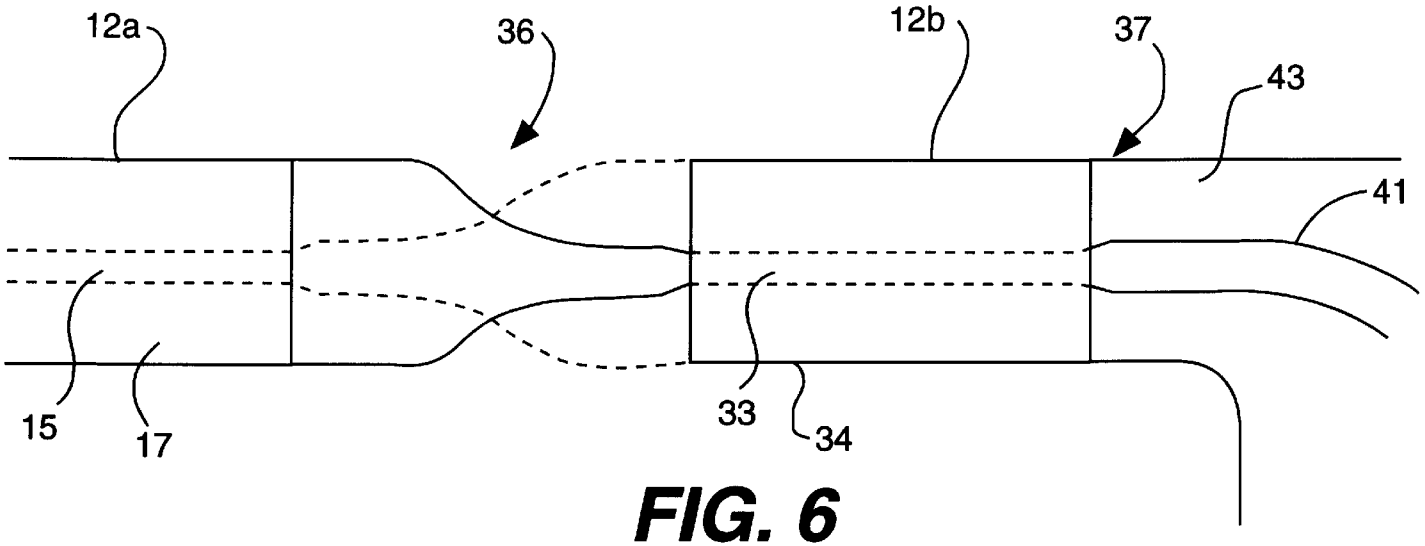
FIG. 6 depicts an inverting transmission line in which the signal inversion occurs in the middle of the transmission line.
Figure 7:
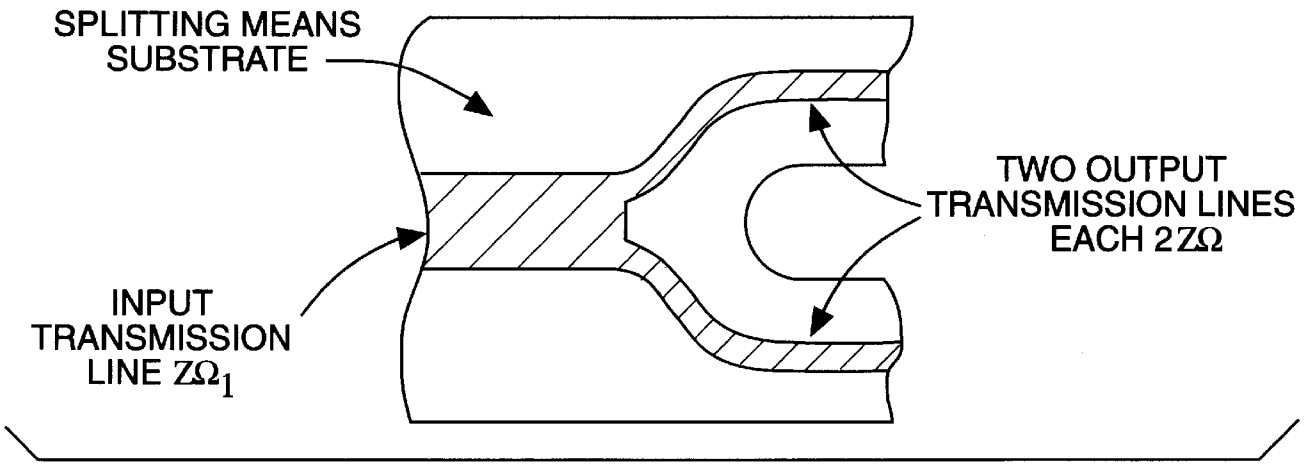
FIG. 7 depicts an input transmission line connected to an input network.

Referring to FIGS. 1–4, embodiment A of the Shielded Stripline Ultra Wide Band Balun is a 4:1 impedance ratio balun comprising two square coaxial transmission lines, one inverting and one non-inverting. FIG. 5 depicts a 9:1 impedance ration balun comprising three square coaxial transmission lines. FIG. 6 depicts a transmission line with the signal line located in the middle of the transmission line. Like elements are identified with like reference numerals in each of the figures.

The balun transmission lines are constructed from three types of printed circuit board transmission line structures: microstrip, stripline, and/or square coaxial line. A microstrip transmission line comprises a thin conductive signal trace and a ground plane separated by a dielectric substrate. A stripline transmission line is similar to microstrip, but stripline comprises an additional ground plane such that the signal trace lies between two ground planes, which are separated from the signal trace by dielectric substrates. Grounding screws can be used to connect the two ground planes. A square coaxial transmission line is similar to stripline, except the ground planes wrap around the dielectric substrate such that they form a square shield that completely encircles the signal line. Stripline and square coaxial line have less signal loss than microstrip when ferrite cores are placed around the transmission line, especially at high frequencies. Microstrip must be used, however, to invert the signal line and ground plane on the inverting transmission line and to connect the transmission lines to the stacking portion of the balun.

The unbalanced input and splitter/combiner section of the balun comprises an end launch or surface launch connector for the unbalanced signal. The splitter/combiner divides the signal into N transmission lines, where N is an integer greater than or equal to two. The impedance of each of the transmission lines, which are comprised of stripline or square coaxial line, is N times that of the unbalanced signal input. U.S. Pat. No. 5,523,728 can be referred to for different embodiments of the input and splitter/combiner portion of the balun.

In embodiment A in FIGS. 1–4, the unbalanced signal input is connected to the balun through surface launch connector 11. The splitter/combiner formed at connector 11 divides the signal into two transmission lines 12 and 13, which are comprised of square coaxial line. Transmission lines 12 and 13 are comprised of thin conductive signal traces 15 and 16, respectively, which lie between the dielectric substrates. Transmission lines 12 and 13 are also comprised of the square shields 17 and 18, which encircle signal traces 15 and 16. The square ground shields 17 and 18 are connected through connector 11 to the shield of the unbalanced input signal. Transmission lines 12 and 13 have twice the characteristic impedance of the unbalanced input signal.

FIG. 5 shows a 9:1 impedance ratio balun comprising three transmission lines. The splitter/combiner divides the unbalanced signal into three transmission lines 12, 13, and 14, with each line having three times the impedance of the unbalance input signal.

The transmission line section of the balun is comprised of inverting and non-inverting transmission lines. The balun must be comprised of at least one inverting and one non-inverting transmission line. All of the transmission lines must have substantially the same characteristic impedance and length. The signal time delay across each transmission line, subsequently, will be the same over all frequencies, as required in order for the balun to operate over a wide bandwidth.

The non-inverting transmission line is comprised of stripline or square coaxial line. At the second end of the non-inverting transmission line, where it connects to the stacking portion of the balun, however, the transmission line must convert to microstrip. Stripline is converted to microstrip by discontinuing the upper ground plane, leaving only the signal line and the lower ground plane separated by a dielectric substrate. At the point where the upper ground plane ends, the signal line is tapered outward to maintain constant impedance. Square coaxial line is converted to microstrip by tapering the square shield so that only the bottom ground plane remains. As with the stripline, the signal line is tapered outward to maintain a constant impedance.

The first end of the inverting transmission line is similarly comprised of stripline or square coaxial line. At the second end of the inverting transmission line, the stripline or square coaxial line must also convert to microstrip in order to connect to the stacking portion of the balun. The inverting transmission line must also convert to microstrip in order to construct the phase inversion between the signal line and ground plane in the sense that the signal with respect to the ground plane at one end is inverted with respect to the signal and ground plane at the other end. This inversion is achieved by tapering the microstrip ground plane inward to form a signal line while simultaneously tapering out the signal line to form a ground plane. The non-inverting and inverting transmission lines are, therefore, carrying signals that are 180 degrees out of phase at their second ends. The signal inversion can occur at the second end of the transmission line where the line must already convert to microstrip in order to connect to the stacking portion of the balun. The signal inversion can, however, occur at any point along the transmission line. After the inversion, the transmission line can be converted back to stripline or square coaxial line.

Referring to embodiment A and FIGS. 1–4, transmission line 13 is a non-inverting square coaxial transmission line, while transmission line 12 is an inverting square coaxial transmission line. Transmission line 13 is comprised of signal line 16 which is between two layers of dielectric substrate. The dielectric substrate is encircled by square shield 18. Shield 18 is divided into two sections, 18*a* and 18*b*, that are connected by resistor-capacitor circuit 19, as will be explained below.

At the second end of the non-inverting transmission line, near the stacking portion of the balun (40), the transmission line converts from square coaxial line to microstrip at point 25. The top and side portions of the square coaxial shield end, and only the bottom portion continues forming ground plane 22 of the microstrip. The square coaxial signal line 16 which transitions to signal line 21 is tapered outward in order to maintain constant impedance. Signal line 21 and ground plane 22 are connected to the stacking portion of the balun as described in U.S. Pat. No. 5,523,728.

Transmission line 12 is an inverting square coaxial transmission line comprised of signal line 15 which is between two layers of dielectric substrate. The dielectric substrate is encircled by square shield 17. At the second end of the inverting transmission line, near the stacking portion of the balun (40), the transmission line converts from square coaxial line to microstrip at point 35. The top and side portions of the square coaxial shield end, and only the bottom portion continues forming ground plane 32 of the microstrip. The square coaxial signal line 15 is tapered outward to form signal line 31 of the microstrip in order to maintain constant impedance.

At point 36, the signal line and ground plane of the inverting transmission line are inverted. Signal line 31 is tapered outward to connect with ground plane 45, and ground plane 32 is tapered inward to connect with signal line 41. Signal line 41 and ground plane 45 form part of the stacking section of the balun, as described in U.S. Pat. No. 5,523,728.

The inversion point of the signal line and ground plane in the inverting signal line need not be at the connecting point to the stacking portion of the balun. FIG. 6 shows an inverting transmission line in which the square coaxial line converts to microstrip, inverts the signal line and ground plane, and converts back to square coaxial line. The square coaxial line then converts back to microstrip in order to connect to the stacking portion of the balun. The dashed lines represent traces on the bottom of the dielectric substrate, and the striped section represents a square shield. The inversion point 36 is shown located in the middle of transmission line 12, comprised of sections 12*a* and 12*b*. The square coaxial line 12*a* at the first end of the inverting transmission line is comprised of signal line 15 and shield 17. At point 36, signal line 15 is tapered outward and around the transmission line to form shield 34, and shield 17 is tapered inward to form signal line 33. Signal line 33 and shield 34 form square coaxial line 12*b*, which converts back to microstrip at point 37 and connects to the stacking part of the balun similarly to embodiment A.

If the unbalanced signal is split into N transmission lines, there must be N−1 resistor-capacitor (RC) circuits to prevent short circuits when DC is applied to the balun. In embodiment A shown in FIGS. 1–4, RC circuit 19 is placed between two sections of the non-inverting transmission line shield 18*a* and 18*b*. If the impedance of the unbalanced input line is Z ohms, the impedance of square coaxial lines 12 and 13 will be 2 Z ohms. Noting that at DC, the resistor (R) in circuit 19 is in parallel with the balanced load, R can be chosen to be 4 Z/3 so that an unbalanced source sees a matched load at DC. The resistor value is typically chosen to be 4 Z/3 for the case where power is going into the input line and going to a load that is broadband matched from GHz to DC. When the load is not broadband matched, the RC network can be adjusted for either maximum power transfer or minimum VSWR. For the case where power is coming into the balanced signal line of the balun, R is typically chosen to be an open circuit since, for this case, an open circuit provides both optimum power transfer and minimum VSWR. The capacitance of RC circuit 19 is typically formed by several capacitors. One of the capacitors is typically a high-Q low ESR (Equivalent Series Resistance) microwave capacitor to effectively be a short circuit at microwave frequencies. Another capacitor is usually a higher value capacitor that is chosen such that the VSWR is 1:1 at all frequencies down to DC. The RC circuit could be placed at other locations in the circuit without affecting performance of the balun.

Figure 1:
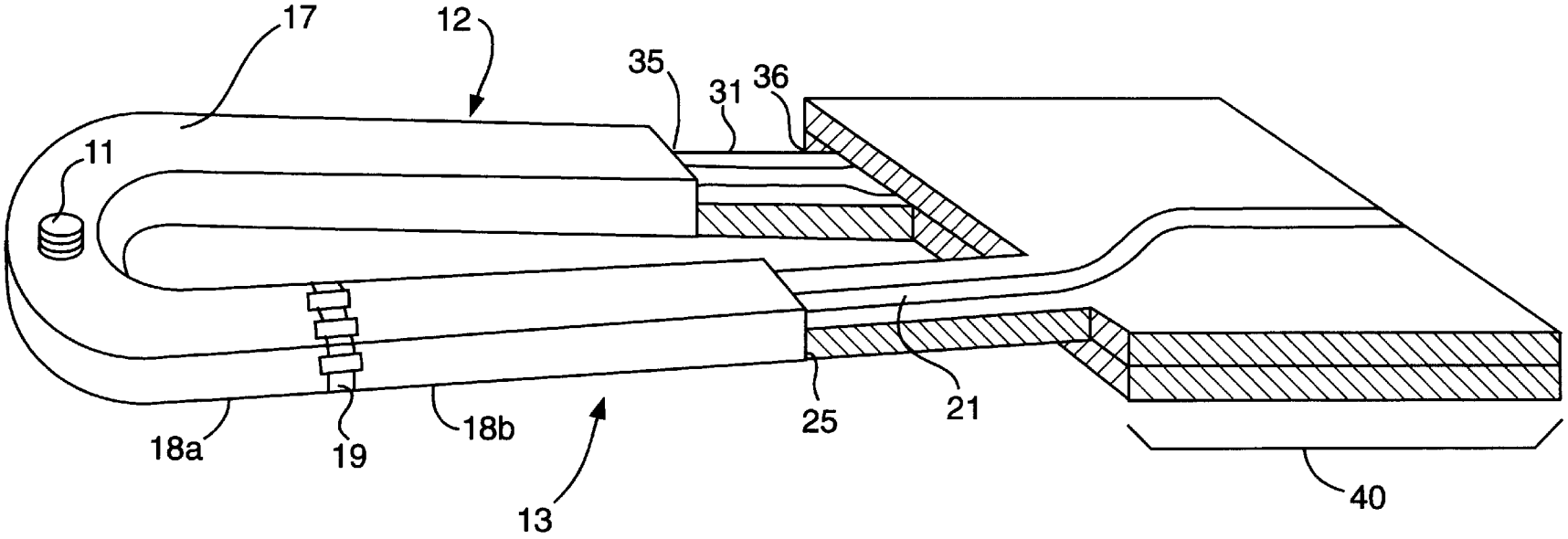
FIG. 1 depicts an elevated side angle view of embodiment A of the balun, a 4:1 impedance ratio balun comprising two square shield coaxial transmission lines.
Figure 2:
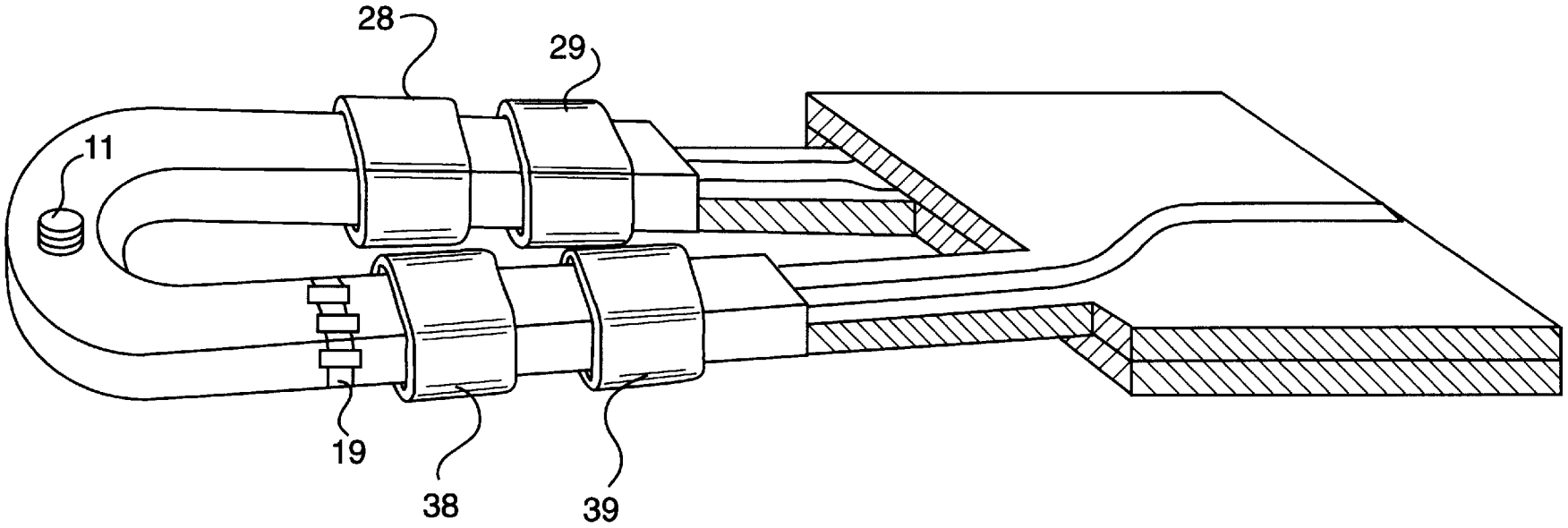
FIG. 2 depicts an elevated side angle view of balun A with ferrite cores around the transmission lines.
Figure 3:
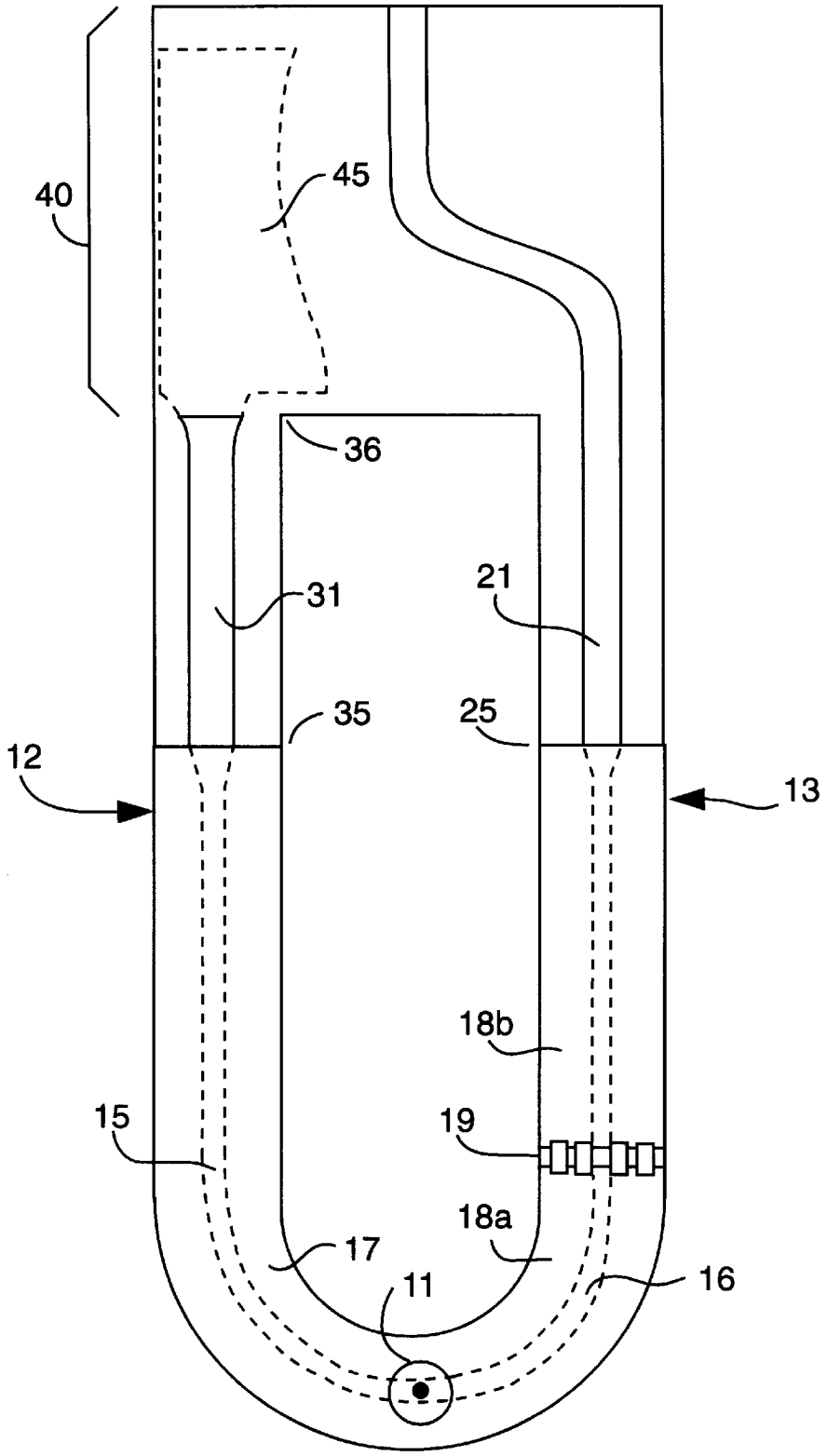
FIG. 3 depicts a top view of balun A, with a cutaway.
Figure 4:
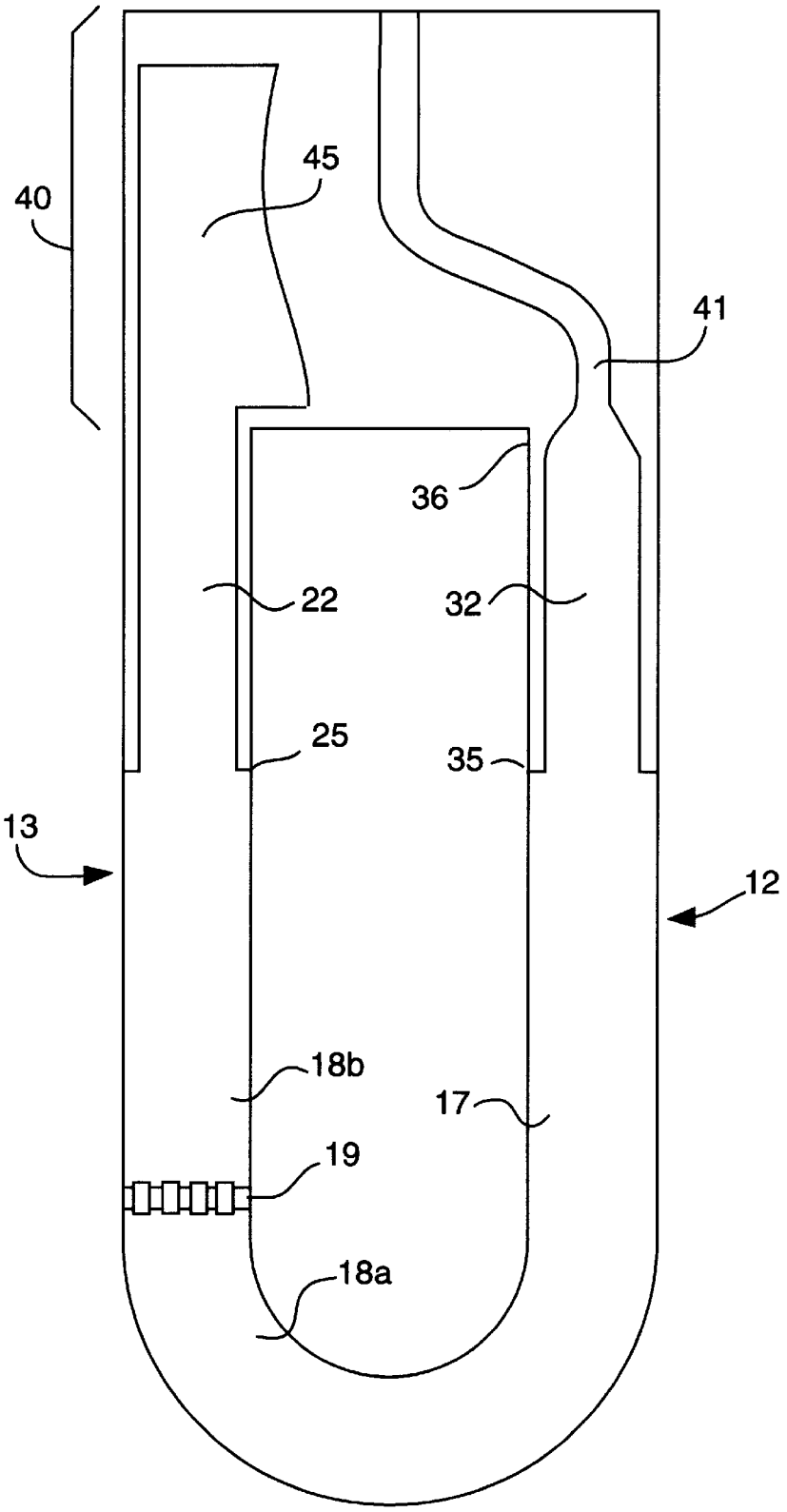
FIG. 4 depicts a bottom view of balun A, with a cutaway.

To extend the low frequency performance of the balun, ferrite cores can be placed around the inverting and non-inverting transmission lines. FIG. 2 shows embodiment A with two cores 28 and 29 placed around the inverting transmission line, and two cores 38 and 39 placed around the non-inverting transmission line. The stripline or shielded coaxial cable prevent the signal loss that occurs at high frequency when ferrite cores are placed around microstrip transmission lines, as in U.S. Pat. No. 5,523,728. If the inversion of the signal in the inverting transmission line occurs at a point before the connection to the field stacking portion of the balun, as in FIG. 6, cores can be placed either before the inversion, after the inversion, or both before and after the inversion.

Obviously numerous modifications and variations of the present invention are possible in light of the above teachings. For example, the RC network could be changed to affect a different matching characteristic if desired or placed in a different location. In addition, although the balun operation as described above describes an unbalanced input being divided into a balanced signal, the balun also operates in the other direction converting a balanced input signal into an unbalanced signal. It is therefore to be understood that within the scope of the appended claims, the invention may be practiced otherwise than as specifically described herein.

What is claimed is:

1. A balun comprised of:

a) An input network;

b) an input transmission line with a characteristic impedance of Z ohms connected to said input network;

c) a parallel splitting means connected to split the said input transmission line into N branch transmission lines, where N is an integer greater than one and where each branch transmission line has a characteristic impedance of N×Z ohms and at least one such branch transmission line is comprised of stripline;

d) N transmission lines with characteristic impedance of N×Z ohms connected to said N branch transmission lines of said parallel splitting means, wherein said N transmission lines are comprised of inverting and non-inverting transmission lines, wherein one or more of the transmission lines has a small gap in a shield thereof;

e) one or more gap networks, wherein each gap network is connected across one of said gaps in said shield of said one or more transmission lines;

f) a series combining means receiving said inverting and non-inverting transmission lines and connecting them in series to produce a single output transmission line of impedance N×N×Z ohms; and g) wherein the electrical length from said input transmission line, through all branches and combining in said series combining means, are matched.

2. A balun as in claim 1 wherein one or more of the said N transmission lines is encircled with ferrite material.

3. A balun comprised of:

a) An input network;

b) an input transmission line with a characteristic impedance of Z ohms connected to said input network;

c) a parallel splitting means connected to split the said input transmission line into N branch transmission lines, where N is an integer greater than one and where each N branch transmission line has a characteristic impedance of N×Z ohms;

d) N transmission lines with characteristic impedance of N×Z ohms connected to said N branch transmission lines of said parallel splitting means, wherein said N branch transmission lines are comprised of inverting and non-inverting transmission lines, wherein one or more of the transmission lines has a small gap in a shield thereof;

e) one or more gap networks, wherein each gap network is connected across one of said gaps in said shield of said one or more transmission lines;

f) a series combining means receiving said N inverting and non-inverting transmission lines and connecting them in series to produce a single output transmission line of impedance N×N×Z ohms;

g) wherein the electrical length from said input transmission lines, through all branches and combining in said combiner, are matched; and wherein:

a) said input transmission line is formed with stripline comprised of:

i) a first dielectric substrate having a first ground on top;

ii) a second dielectric substrate having a second ground on the bottom and a signal trace on the top wherein said second ground is connected to said first ground, and wherein the signal trace has a width to form a transmission line of-characteristic impedance Z ohms;

b) said parallel splitting means is formed with a stripline circuit comprised of:

i) said first dielectric substrate having a first ground on top;

ii) said second dielectric substrate having a second ground on the bottom and a signal trace on the top wherein said second ground is connected to said first ground, and wherein said first signal trace has an input side with a width to form a transmission line of characteristic impedance Z ohms, a junction breaking out to N signal traces each with a width to form a transmission line of impedance N×Z ohms, where N=2;

c) said non-inverting transmission lines are stripline comprised of a first and second dielectric substrate with a first ground on the top of the first dielectric substrate, a second ground on the bottom of the second dielectric substrate connected to said first ground, and a signal trace on the top of the second dielectric substrate between said first and second grounds, and with a width to provide a characteristic impedance of N×Z ohms;

d) said inverting transmission lines are comprised of:

i) a first stripline section, comprised of a first and second dielectric substrate with a first ground on the top of the first dielectric substrate, a second ground on the bottom of the second dielectric substrate connected to said first ground, and a signal trace on the top of the second dielectric substrate between the said first and second grounds, and with a width to provide a characteristic impedance of N×Z ohms;

ii) a stripline-to-microstrip transition connected to said first stripline section wherein said first dielectric substrate stops, and said signal trace on said second dielectric substrate transitions to become wider to maintain constant impedance;

iii) a microstrip-to-balanced transition connected to said stripline-to-microstrip transition wherein said second ground on said second dielectric substrate becomes narrower and said signal trace becomes wider to maintain constant impedance throughout, and ending with both said signal trace and said second ground being equal in width;

iv) a balanced-to-microstrip transition connected to said microstrip-to-balanced transition wherein said signal trace tapers outwardly to become a ground on the top of said second dielectric substrate while simultaneously, said second ground becomes narrower to become a signal trace on the bottom of said second dielectric substrate;

v) a microstrip-to-stripline transition connected to said balanced-to-microstrip transition comprised of:

(a) said second dielectric substrate with said signal trace on the bottom of said second dielectric substrate transitioning to become narrower to maintain constant impedance throughout, and (b) a third dielectric substrate with a ground on its bottom and its top pressed against said signal trace on the bottom of said second dielectric substrate, wherein said ground on the bottom of said third dielectric substrate is connected to said ground on top of said second dielectric substrate;

vi) a second stripline section, comprised of said second and third dielectric substrates together with said second and third dielectric substrate grounds, and a signal trace positioned on top of the third dielectric substrate with a width to provide a characteristic impedance of N×Z ohms;

e) said series combining means is comprised of:

i) a first stripline-to-microstrip transition connected to said non-inverting transmission line wherein the first dielectric substrate of said non-inverting transmission line stops and the signal trace on the top of the second dielectric substrate tapers outwardly to maintain a characteristic impedance of N×Z ohms;

ii) a second stripline-to-microstrip transition connected to said second stripline section of said inverting transmission line wherein the third dielectric substrate of said non-inverting transmission line stops and the signal trace on the bottom of the second dielectric substrate tapers outwardly to maintain a characteristic impedance of N×Z ohms;

iii) a microstrip field stacking section comprised of two dielectric substrates, a top dielectric substrate comprised of the second dielectric substrate of said first stripline-to-microstrip transition with a ground plane on the bottom and a first signal trace on the top, and a bottom dielectric substrate comprised of the second dielectric substrate of said second stripline-to-microstrip transition with a ground plane on the top and a signal trace on the bottom, wherein the ground planes are pressed together and electrically connected, and wherein the signal traces curve so that they are positioned on top of one another.

4. A balun as in claim 3 wherein one or more of said N transmission lines is encircled with ferrite material.

5. A balun as in claim 3 wherein:

a) said input network is a series capacitor;

b) said gap network is a capacitor;

c) a third port is comprised of the signal across one of the said gaps, for conducting low frequencies to and from an external load or source;

d) said input network conducts high frequencies to or from an external load or source.

6. A balun as in claim 4 wherein:

a) said input network is a series capacitor;

b) said gap network is a capacitor;

c) a third port is comprised of the signal across one of the said gaps, for conducting low frequencies to and from an external load or source;

d) said input network conducts high frequencies to or from an external load or source.

7. A balun as in claim 3 wherein:

a) said input network is a series short-circuit;

b) said gap network is a parallel resistor capacitor.

8. A balun as in claim 7 wherein said resistor has a value of (N*N*Z)/(N*N−1).

9. A balun as in claim 4 wherein:

a) said input network is a series short-circuit;

b) said gap network is a parallel resistor capacitor.

10. A balun as in claim 9 wherein said resistor has a value of (N*N*Z)/(N*N−1).

11. A balun as in claim 3 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

12. A balun as in claim 4 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

13. A balun as in claim 5 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

14. A balun as in claim 6 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

15. A balun as in claim 7 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

16. A balun as in claim 8 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

17. A balun as in claim 9 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

18. A balun as in claim 10 wherein:

a) said N is greater than 2;

b) said series combining means is comprised of a plurality of N said stripline to microstrip transitions each followed by a microstrip to balanced transition; with said microstrip field stacking section comprised of a plurality of N substrates.

19. A balun as in claim 1 wherein:

A. said input transmission line, formed with stripline is comprised of:

1. a first dielectric substrate having a first ground on top;

2. a second dielectric substrate having a second ground on the bottom and a signal trace on the top wherein said second ground is connected to said first ground, and wherein the signal trace has a width to form a transmission line of characteristic impedance Z ohms;

B. the parallel splitting means is formed with a stripline circuit comprised of:

1. said first dielectric substrate having a first ground on top;
2. said second dielectric substrate having a second ground on the bottom and a signal trace on the top wherein said second ground is connected to said first ground, and wherein said signal trace has an input side with a width to form a transmission line of characteristic impedance Z ohms, a junction breaking out to N signal traces each with a width to form a transmission line of impedance N×Z ohms, where N=2;

C. said non-inverting transmission lines are comprised of a first and second dielectric substrate with a first ground on the top of the first dielectric substrate, a second ground on the bottom of the second dielectric substrate connected to said first ground, and a signal trace on the top of the second dielectric substrate between the said first and second grounds, and with a width to provide a characteristic impedance of N×Z ohms;

D. said inverting transmission lines are comprised of:
1. a first stripline section, comprised of a first and second dielectric substrate with a first ground on the top of the first dielectric substrate, a second ground on the bottom of the second dielectric substrate connected to said first ground, and a signal trace on the top of the second dielectric substrate between said first and second grounds, and with a width to provide a characteristic impedance of N×Z ohms;
2. a stripline-to-microstrip transition connected to said first stripline section wherein said first dielectric substrate stops, and said signal trace on said second dielectric substrate transitions to become wider to maintain constant impedance;
3. a microstrip to balanced transition connected to said stripline-to-microstrip transition wherein said second ground on said second dielectric substrate becomes narrower and said signal trace becomes wider to maintain constant impedance throughout and ending with both said signal trace and said second ground being equal in width;
4. a balanced to microstrip transition connected to said microstrip-to-balanced transition wherein said first signal trace tapers outwardly to become a third ground on the top of said second dielectric substrates while simultaneously, said second ground becomes narrower to become a signal trace on the bottom of said second dielectric substrate;
5. a microstrip-to-stripline transition connected to said balanced-to-microstrip transition comprised of:
   a) said second dielectric substrate with said signal trace on the bottom of said second dielectric substrate transitioning to become narrower to maintain constant impedance throughout, and
   b) a third dielectric substrate with a fourth ground on its bottom and its top pressed against said signal trace on the bottom of said second dielectric substrate, wherein said ground on the bottom of said second dielectric substrate is connected to said ground on top of said second dielectric substrate;
6. a second stripline section, comprised of said second and third dielectric substrates together with said second and third dielectric substrate grounds, and a signal trace positioned on top of the third dielectric substrate with a width to provide a characteristic impedance of N×Z ohms;

E. said series combining means is comprised of:
1. a first stripline-to-microstrip transition connected to said non-inverting transmission line wherein the first dielectric substrate of said non-inverting transmission line stops and the signal trace on the top of the second dielectric substrate tapers outwardly to maintain a characteristic impedance of N×Z ohms;
2. a second stripline-to-microstrip transition connected to said second stripline section of said inverting transmission line wherein the third dielectric substrate of said non-inverting transmission line stops and the signal trace on the bottom of the second dielectric substrate tapers outwardly to maintain a characteristic impedance of N×Z ohms;
3. a microstrip field stacking section comprised of two dielectric substrates, a top dielectric substrate comprised of the second dielectric substrate of said first stripline-to-microstrip transition with a ground plane on the bottom and a first signal trace on the top, and a bottom dielectric substrate comprised of the second dielectric substrate of said second stripline-to-microstrip transition with a ground plane on the top and a signal trace on the bottom, wherein the ground planes are tapered outwardly, are pressed together and electrically connected, and wherein the signal traces curve so that they become positioned on top of one another;
4. a transition from stacked microstrip transmission lines, to balanced transmission lines where said pressed-together grounds stop, while said signal trace on the top of said top dielectric substrate, and said signal trace on the bottom of said bottom dielectric substrate continue to the edge of said top and bottom dielectric substrates, respectively;

F. wherein the electrical length from said input transmission line, through said splitter, said branches and said combiner, are matched.

* * * * *